United States Patent [19]

Papajewski et al.

[11] 3,960,098

[45] June 1, 1976

[54] THREAD WIPER AND TENSION RELEASE MECHANISM FOR SECURING MACHINES

[75] Inventors: Reinhold Papajewski, Buchig; Helmer Heinz Holl, Karlsruhe, both of Germany

[73] Assignee: The Singer Company, New York, N.Y.

[22] Filed: Dec. 18, 1974

[21] Appl. No.: 534,012

[52] U.S. Cl. ..... 112/252; 112/238

[51] Int. Cl.[2] ..... D05B 65/00

[58] Field of Search ..... 112/65, 67, 73, 187, 112/219 A, 221, 223, 238, 239, 243, 245, 252

[56] References Cited

UNITED STATES PATENTS

| | | | |
|---|---|---|---|
| 2,822,771 | 2/1958 | Hale et al. | 112/65 |
| 2,928,362 | 3/1960 | Benink et al. | 112/67 |
| 2,962,992 | 12/1960 | Johnson et al. | 112/238 X |
| 3,448,708 | 6/1969 | Ross | 112/67 X |
| 3,695,200 | 10/1972 | Papajewski et al. | 112/243 |

*Primary Examiner*—Werner H. Schroeder
*Assistant Examiner*—Moshe I. Cohen
*Attorney, Agent, or Firm*—Robert E. Smith; Edward L. Bell; Julian Falk

[57] ABSTRACT

A mechanism is disclosed in which the main driving mechanism of a sewing machine is harnessed simultaneously to actuate a thread wiper and a tension release mechanism for the sewing machine. Operation of the mechanism may be initiated by a solenoid which may be advantageously small in size and power since the solenoid does not supply any of the driving force incident to the operation of the thread wiper or tension release mechanisms.

4 Claims, 4 Drawing Figures

THREAD WIPER AND TENSION RELEASE MECHANISM FOR SECURING MACHINES

BACKGROUND OF THE INVENTION

In sewing machines equipped with underbed thread trimming devices for severing the needle thread, it is known to correlate the release and reestablishment of the needle thread tension and the preparatory and active strokes of a needle thread wiper with the operation of the thread trimmer to facilitate a predictable and efficient operation.

It is preferable, for instance, for the thread wiper to partake of its preparatory or thread engaging movement while the thread is taut before it is severed, and for the active thread wiping stroke to occur after the thread is severed to prevent the thread from catching in the work which might cause a long thread end to be pulled out as the work is removed. Similarly, it is desirable for the needle thread tension to be released prior to thread severing to facilitate the drawing down of sufficient thread to preserve appropriate thread end length for starting the next line of stitching, and for the needle thread tension to be restored during the thread wiper operation thus forcing the wiper to withdraw the severed thread end from the work rather than drawing additional thread from the supply.

A construction is known in which one solenoid is connected directly to both the thread wiper and to the tension release mechanism. In this known construction in response to electrical signals related to particular stages of operation of the thread trimmer, the wiper is retracted and the tension is released directly as a result of the operation of the solenoid whereas the wiper is given an active stroke and the tension is restored when the solenoid is deenergized. In the known construction a large and powerful solenoid is required to provide the driving forces to move the wiper and to release the tension.

SUMMARY OF THE INVENTION

This invention provides a thread wiper and a needle thread tensioning arrangement which may be operated in the preferential mode as discussed above but in which the driving forces for moving the wiper and releasing the tension are derived from the sewing machine actuating mechanism.

In the preferred embodiment illustrated in the accompanying drawings one very small solenoid suffices to render selectively effective the mechanism for operating the thread wiper and for releasing the tension. The size of the solenoid in the construction disclosed in the preferred embodiment is uninfluenced by the magnitude of the forces necessary to drive the wiper or tension releaser.

DESCRIPTION OF THE DRAWINGS

In the accompanying drawings.

DESCRIPTION OF THE PREFERRED EMBODIMENT

Figures 1, 2, 3, 4:
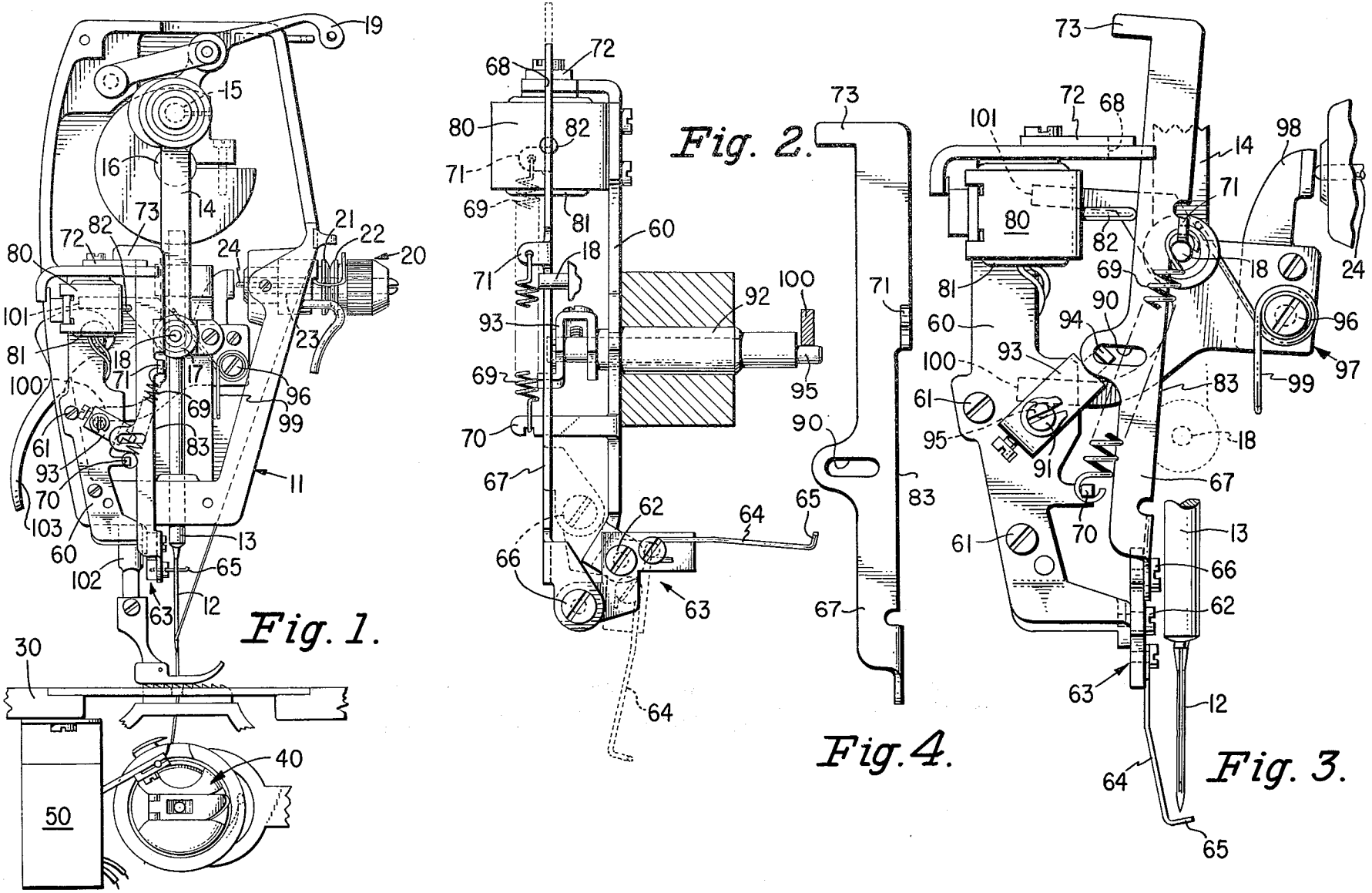
FIG. 1 is a head-end elevational view of a portion of a sewing machine having this invention applied thereto, showing the parts in position for sewing with the solenoid deenergized.
FIG. 2 is an enlarged side elevational view of the mechanism shown in FIG. 1 with the thread wiper illustrated in solid lines in the at-rest position occupied during sewing and in dashed lines in the retracted position in readiness to wipe the thread.
FIG. 3 is an enlarged head-end elevational view of portions of the sewing machine illustrated in FIG. 1 but showing the position of parts with the solenoid energized and the thread wiper and needle thread tension release devices operated by the actuating mechanism of the sewing machine.
FIG. 4 is an elevational view showing the control member alone out of the assembly of parts illustrated in FIG. 3.

Indicated at 11 in the drawing is the sewing head of a sewing machine bracket arm. A needle 12 is secured to a needle bar 13 which is endwise reciprocable in the sewing head 11 and to which reciprocatory motion is imparted by a drive link 14 embracing a crank pin 15 carried on a rotary main shaft 16 journaled in the bracket arm. The drive link engages a bearing 17 on a stud 18 which is carried for reciprocatory movement with the needle bar.

Also actuated by the crank pin 15 is a take-up lever 19 for the needle thread which operates to influence the thread extending between a thread tension device 20 and the needle 12. The thread tension device may be of any known form preferably of the type in which the thread passes between opposed discs 21, 22 which are biased toward each other on a hollow stud 23, within which a tension release pin 24 is shiftably arranged so as to force the discs 21 and 22 apart when it is desired to release the tension on the thread.

The sewing machine includes a work supporting bed 30 beneath which is arranged stitch forming instrumentalities 40 with which an underbed thread trimming device 50 is associated. Any conventional stitch forming instrumentalities and thread trimming device may be used with this invention, as for instance, that disclosed in the U.S. Pat. No. 3,386,402, June 4, 1968 of R. Ross which is incorporated herein by reference.

For an understanding of this invention, it will be sufficient to know that the thread trimming device of the referenced patent becomes effective during a downstroke of the needle to engage a loop of needle thread being concatenated by the stitch forming instrumentalities. During the succeeding needle upstroke, the trimmer is actuated to sever the detained needle thread loop, and usually also any bobbin or looper threads.

The thread wiping and tension releasing mechanism of this invention is assembled on a support bracket 60 which is fastened as by screws 61 to the sewing head 11. Pivotally supported on a fulcrum screw 62 in the bracket 60 is a thread wiper lever 63 carrying on one arm a wire 64 formed with a thread engaging hook 65. The other arm of the thread wiper lever 63 is joined by a pivotal connection 66 with a control member 67 capable of being bodily displaced. The control member is constrained loosely on the pivotal connection 66 so that not only can it turn relatively to the thread wiper lever about the axis of the pivotal connection 66, but it can also pivot a limited amount about an axis at right angles thereto. At the upper extermity, the control member is constrained within a guide slot 68 formed in the bracket 60.

A coil spring 69 stretched between an anchor lug 70 on the bracket 60 and a lug 71 offset from the control member 67 biases the control member downwardly and also toward the left as viewed in FIGS. 1 and 3 toward the bottom of the guide slot 68. A damping element 72 of resilient material may be carried by the bracket 60 for engagement by an extension 73 of the control member.

The bracket 60 carries a small electric solenoid 80 which may be conventional in construction and includes an activating coil 81 and an armature including a cylindrical stud 82 shiftable axially toward the right as viewed in FIGS. 1 and 3 when the coil is energized. The solenoid armature stud 82 is positioned to engage and shift the control member 67 to the right as viewed in FIG. 3.

The control member 67 is formed with a shallow recess 83 beneath the lug 71 so that when shifted by the solenoid, the lug 71 will move into a position overlying the path of motion of the stud 18 on the needle bar. After the solenoid is energized, control member 67 will be displaced upwardly by the stud 18 on the succeeding upstroke of the needle bar to the position as shown in FIG. 3 and in dashed lines in FIG. 2. During this elevation of the control member the thread wiper will be driven in its retracting stroke carrying the hook 65 across and into engagement with the thread extending between the needle and the work fabric.

The sewing machine will be stopped in this position of the parts by the regular operation of the underbed thread trimmer and with the needle raised and the wiper retracted, the sewing threads will be severed beneath the bed.

Thereafter, when the solenoid is deenergized, the control member 67 will be freed from engagement with the stud 18 for return by the coil spring 69 during which displacement the thread wiper lever will be moved in its active stroke causing the hook 65 to wipe the thread end out of the work fabric.

Release and restoration of the needle thread tension is coordinated with the retraction and thread wiping strokes of the thread wiper lever by means of a slot 90 formed in the control member 67 substantially perpendicular to the recess 83. A rock shaft 91 journaled in a bushing 92 on the bracket 60 carries a rock arm 93 formed with an offset finger 94 engaged in the slot 90. The rock shaft 91 is formed with an eccentric crank 95.

Mounted crosswise in the sewing head 11 on a fulcrum pin 96 is a tension releasing lever 97 having on one side of the fulcrum a lever arm 98 engageable with the release pin 24 of the tension device, but biased away from the release pin by a light spring 99. At the opposite side of the fulcrum, the tension releasing lever 97 is formed with spaced lever arms 100 and 101 of which lever arm 100 overlies the eccentric crank 95 for operation thereby, and lever arm 101 may be elevated when the presser bar 102 is raised manually by a presser lifting lever 103.

Having set forth the nature of this invention, what is claimed herein is:

1. A needle thread tension release and wiping mechanism for sewing machines of the type including a sewing needle, actuating mechanism for reciprocating said needle, needle thread severing means, a needle thread wiper, and a needle thread tensioning device including a tension releasing means, the improvement comprising a control member, drive means associated with said actuating mechanism for influencing displacement of said control member, linkage operatively connecting both said needle thread wiper and said tension releasing means to said control member for actuation in response to said displacement of said control member, and a solenoid selectively effective to establish operative connection between said drive means and said control member.

2. A needle thread tension release and wiping mechanism for sewing machines as set forth in claim 1 in which said drive means includes a stud carried for reciprocation with said needle, in which a bracket secured to said sewing machine constrains said control member for said displacement in a direction substantially parallel to the path of reciprocation of said stud, and in which said solenoid is carried by said bracket and arranged to urge said control member laterally of the direction of said displacement to establish operative connection of said control member with said stud.

3. A needle thread tension release and wiping mechanism for sewing machines as set forth in claim 1 in which a support bracket secured to said sewing machine carries a guide slot constraining said control member for displacement in response to said drive means, in which said solenoid is carried by said support bracket and arranged to urge said control member transversely of said guide slot, and in which spring means hinged on said support bracket urges said control member in opposition to both said drive means and to said solenoid.

4. A needle thread tension release and wiping mechanism for sewing machines as set forth in claim 2 in which said linkage connecting said control member with said thread wiper includes a thread wiper lever and means pivotally interconnecting said control member with said thread wiper lever, in which said linkage connecting said control member with said tension releasing means includes a rock shaft carried by said support bracket a rock arm fast on said rock shaft and a lateral finger carried on said rock arm engaged in a slot formed in said control member of elongated shape extending substantially perpendicular to the direction of said displacement.

* * * * *